United States Patent [19]

Bergen et al.

[11] Patent Number: 4,724,509

[45] Date of Patent: Feb. 9, 1988

[54] EFFICIENTLY MOUNTED LONG CORONODES

[75] Inventors: Richard F. Bergen, Ontario; Michael J. Levy, Henrietta, both of N.Y.

[73] Assignee: Xerox Corporation, Stamford, Conn.

[21] Appl. No.: 889,553

[22] Filed: Jul. 25, 1986

[51] Int. Cl.[4] ..... G03G 15/02

[52] U.S. Cl. ..... 361/230; 355/3 CH

[58] Field of Search ..... 361/214, 229, 230, 234; 250/324–326; 355/3 CH; 55/153

[56] References Cited

U.S. PATENT DOCUMENTS

| | | | |
|---|---|---|---|
| 2,932,742 | 4/1960 | Ebert | 355/3 CH |
| 3,470,417 | 9/1969 | Gibbons | 250/324 |
| 3,764,804 | 10/1973 | Hirschman | 250/324 |
| 3,774,372 | 11/1973 | Heer et al. | 55/153 X |
| 3,875,407 | 4/1975 | Hayne | 250/324 |
| 4,109,289 | 8/1978 | Kuge et al. | 361/230 |
| 4,203,144 | 5/1980 | Okamoto | 361/234 |

FOREIGN PATENT DOCUMENTS

| | | | |
|---|---|---|---|
| 0147206 | 7/1985 | European Pat. Off. . | |
| 52-12841 | 1/1977 | Japan | 250/324 |

*Primary Examiner*—L. T. Hix
*Assistant Examiner*—D. Rutledge
*Attorney, Agent, or Firm*—William A. Henry, II

[57] ABSTRACT

A charging unit that is adaptable for use over indeterminate lengths without singing and sagging of corona wire(s) includes stringing the wire around pins positioned in the base of the charging unit in zig-zag fashion in order to provide overlap of charging from multiple segments of the wire. Alternatively, the wire(s) could be supported by a series of monofilaments positioned orthogonal to the direction of the wire(s) at periodic intervals. These charging units may be employed in either a corotron or scorotron configuration.

16 Claims, 6 Drawing Figures

EFFICIENTLY MOUNTED LONG CORONODES

BACKGROUND OF THE INVENTION

This invention relates to a method and apparatus for efficiently mounting coronodes in charging units, in copiers or the like, and more particularly, to a method and apparatus for mounting long coronodes that minimize singing and sagging of the coronodes in copiers or the like.

There are many corotrons and scorotrons that employ a thin wire for a coronode. In instances where a wire is close to a shield, screen or receptor over long distances, there can be a tendency for the wire to sag and/or oscillate. This problem grows in severity as the length of the device is increased. Obviously, this singing and sagging of coronode wire could be detrimental to the operation of the charging unit.

Various solutions have been advanced toward minimizing the above-mentioned problems, for example, U.S. Pat. No. 3,875,407 shows the use of insulated pins to support a coronode outside of its corona generating region. A central support that presses a coronode outwardly at its central portion is described in U.S. Pat. No. 4,203,144. In European Patent Application No. 0,147,206A2 a segmented coronode scorotron charging device is described that includes the supporting of a long coronode on the insulating sides of an open box. The coronode is arranged in an overlapping diagonal pattern to provide uniform charging. Japanese Kokia reference, No. 52-12841 teaches a similar overlapping pattern. U.S. Pat. No. 3,764,804 describes the use of monofilament lines to guide paper near a coronode. The monofilament is never in contact with the coronode itself. Pins that support coronode wires are shown on opposite sides of a central opening in U.S. Pat. No. 3,470,417. Even with this activity, a solution to the problem of singing and sagging of long coronode wires that is cheap and efficient is still needed.

SUMMARY OF THE INVENTION

Accordingly, a charging unit is disclosed that includes the stringing of a coronode wire around insulated pins that are fixed in the base of the charging unit. The stringing zig-zags provide overlap of charging from multiple segments of the wire. An alternative charging unit is disclosed that periodically supports a long coronode wire or multiple wires with monofilament lines to prevent singing and sagging.

BRIEF DESCRIPTION OF THE DRAWINGS

Other features and aspects of the present invention will be apparent as the following description proceeds and upon reference to the drawings, in which.

DETAILED DESCRIPTION OF THE PREFERRED EMBODIMENTS

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
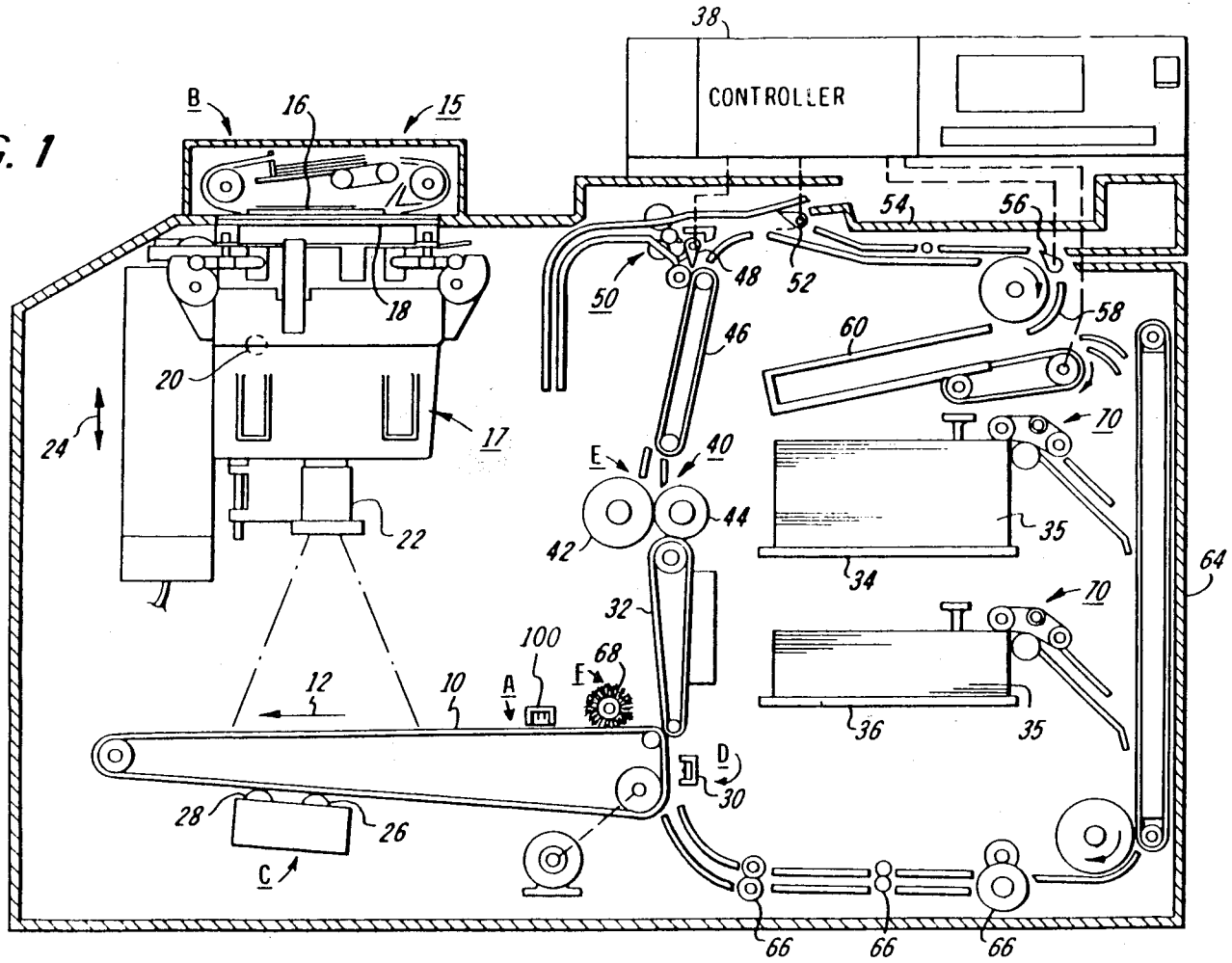
FIG. 1 is a schematic elevational view showing an electrophotographic copier employing the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic copier incorporating the charging apparatus of the present invention.

Inasmuch as the art of electrophotographic printing is well known, the various processing stations employed in FIG. 1 copier will be shown hereinafter schematically and their operation described briefly with reference thereto. It should be understood that the present invention will work just as well in a printer as in a copier or in any other device that uses corotrons or scorotrons.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device in accordance with the present invention, indicated generally by the reference numeral 100, charges the photoconductive surface to a relatively high substantially uniform potential.

Next, the charged portion of the photoconductive surface is advanced through imaging station B. At imaging station B, a document handling unit, indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrow 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a printing machine which does not include a document handling unit.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30, which could have a coronode wire supported in accordance with the present invention, sprays ions onto the backside of the copy sheet. This attracts the toner powder image from the photoconductive surface of belt 10 to the sheet. After transfer, conveyor 32 advances the sheet to fusing station E.

The copy sheets are fed from a selected one of trays 34 or 36 to transfer station D. Each of these trays sense the size of the copy sheet and send an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed seriatim by bottom feeder 62 back to transfer station D for transfer of the tone powder image to the opposed side of the sheet. Conveyors 64 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

Figure 2A:
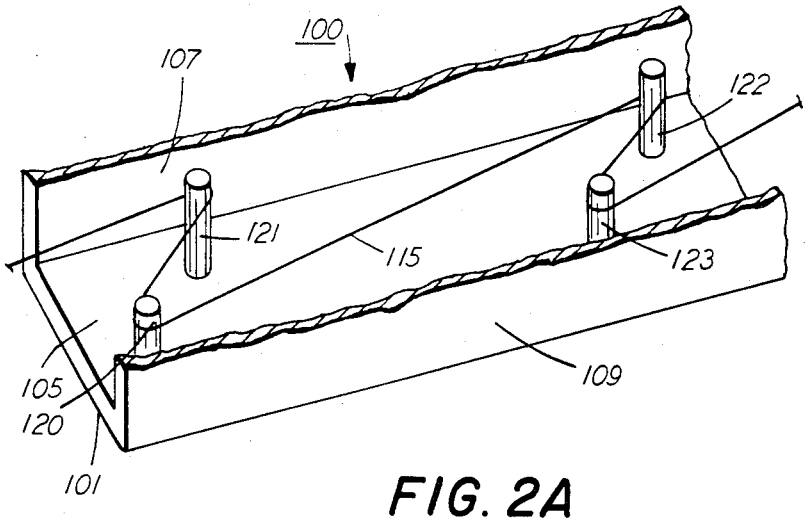
FIG. 2A is a partial perspective view of an aspect of the present invention showing the stringing of a coronode wire around pins along the length of the charging unit of FIG. 1.
Figure 2B:
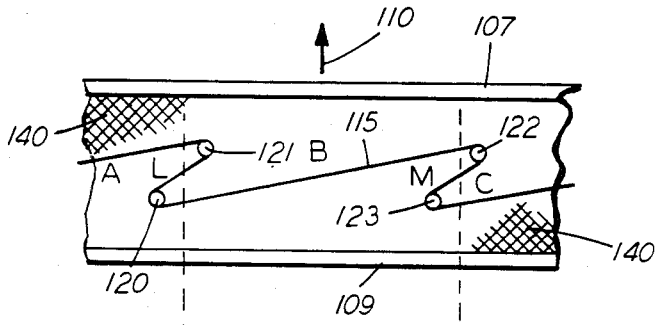
FIGS. 2B and 2C illustrate how a receiver moving in a direction perpendicular to the charging unit of FIG. 2A would receive charging contribution from each segment of the wire.
Figure 2C:
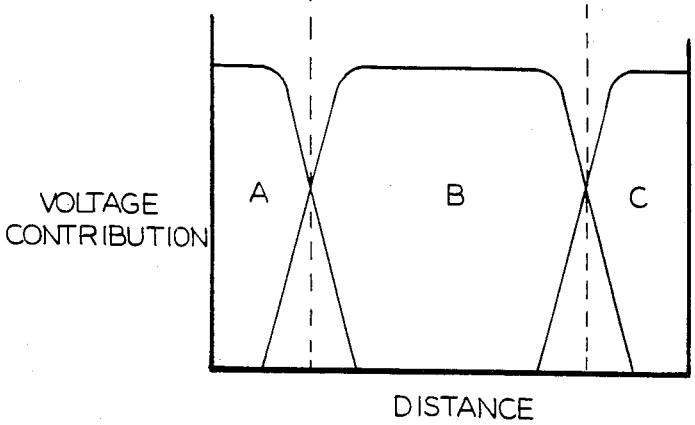

Turning now to an aspect of the present invention, a scorotron corona generating charging unit 100 is shown in FIGS. 1 and 2 that allows charging units to be made in extended lengths, for example 36", without regard to singing and sagging of the coronode wire(s). While a scorotron is shown, it should be understood that a corotron charging unit could be used also as an aspect of the present invention. In FIG. 2A, a U-shaped housing 101, shown inverted and expanded for clarity, has a base 105 and upstanding legs 107 and 109. The sides or legs 107 and 109 extend orthogonal to the base and form an open channel through the charging unit. A coronode wire 115 is supported by pins 120–123 that are notched or grooved to accept the wire without the wire being susceptible to slipping along the surface of the pins. The pins are insulated and positioned in the base of and throughout the length of the charging unit. Insulation of the pins can be by coating or any other suitable means. The top of the pins, when a screen is used for scorotron charging, could also act as spacers/or points for attachment of the screen. At points near the pins, corona will be supressed. However, by adjusting the pins locations in pairs, a proper balance of corona output will be obtained. The same procedure applies to each set of pins. As seen in FIG. 2A, the pins are offset with respect to each other in their locations on opposite sides of the charging unit, but in line with each other on a particular side of the charging unit. Therefore, a receiver such as photoconductive belt 10, moving in a direction orthogonal or perpendicular to the charging unit as indicated by arrow 110 receives a charging contribution from each segment of the wire as seen in FIGS. 2B–2C. Near the pins, where the wire diminishes in output in segment A, the portion of the wire in segment B is increasing, and as voltage contribution from segment B diminishes, the voltage from segment C is increasing, etc. Thus, by proper positioning of the pins, a uniform charging system is fashioned. Wire portions between L and M of FIG. 2B could be coated with an insulator to prevent corona. A screen 140 as shown in FIG. 1 is preferably used with this device in order to smooth out charge levels. It has been found through tests that a screen ⅛ inch away from a coronode wire has a leveling feature that reduces stringing constraints. At 4 inches/sec, for charging speed for a 1 mil Mylar receiver, a 30 volt gradual surface potential variation was measured on an electrometer over an 8 inch trace. This represents a +1.6% uniformity variation on a −925 volt D.C. average surface voltage.

Figure 3A:
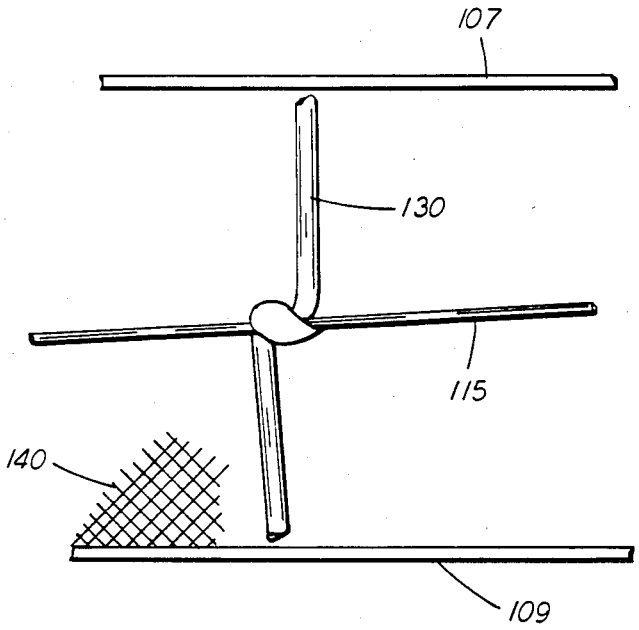
FIGS. 3A and 3B show alternative embodiments of the present invention where a coronode wire is supported by a monofilament wire periodically throughout the length of a charging unit.
Figure 3B:
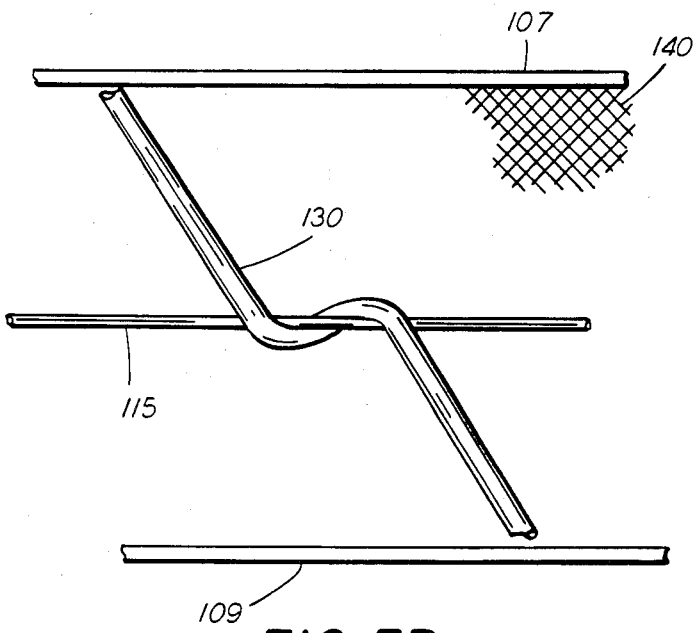

Alternative embodiments of the present invention are shown in FIGS. 3A and 3B where a monofilament 130 makes direct contact with coronode wire 115 in order to stabilize the wire and prevent singing and sagging of the wire over indeterminate lengths. The wire is supported with a monofilament line running perpendicular to the wire, with intersections every few inches. A local suppression is evident particularly with a corotron, but it is limited in amount and distance. A scorotron reduces the differences in charging by its ability to move charges to the lower charging regions. It was discovered that where a monofilament, such as Nylon, does not make direct contact with the wire, the suppression effect is much more noticeable. To overcome this situation, the monofilament line can be alternately laced around or over and under the coronode wire. This periodic support of long corotron wires with a monofilament to prevent singing and sagging is especially effective for scorotron type devices where the screen smooths out non-uniformities. The filament supports are attached to upstanding member 107 and 109 by any suitable conventional means. A screen 140 is used for charge leveling.

In practice, with a charging unit such as shown in U.S. Pat. No. 4,591,713, a 3 mil diameter monofilament line (insulating) was strung around a 1.5 mil diameter coronode wire to prevent sag, as illustrated in FIG. 3A. Three points along the coronode wire were supported in the manner shown. The coronode wire was spaced 4 mm from a 9 mil thick, 52% open screen with the screen to receiver (1 mil Mylar) distance at 1.5 mm. The unit showed charging uniformity at 2, 3, and 6 inches/sec. When charged to near asymptote voltage, very uniform results (+1.5%) were obtained.

It should now be apparent that methods and apparatuses have been disclosed that minimize singing and sagging in coronode wires over long lengths and includes stringing coronodes around pins fixed in the base of a charging unit. The stringing zig-zags to provide overlap of charging from several segments of the wires. Also, monofilaments are represented as usable with coronode wires as perpendicular support means for stabilizing long coronode wires. It should be understood that even though the present invention has been described with reference to one wire as the coronode, a plurality of wires have been shown to aid in smoothing out charge, i.e., improves uniformity of the surface potential.

What is claimed is:

1. A corotron charging device adaptable for charging a surface passing orthogonal thereto over long lengths and through a charging region thereof, comprising:

a support member having a predetermined length;

side members attached to and extending orthogonal to said support member;

a plurality of pins positioned within said charging region on a surface of said support member throughout the length of said support member and spaced a predetermined distance from said side members; and a coronode wire extending said predetermined length of said support member and supported by said plurality of pins within said charging region of said charging device.

2. The corotron charging device of claim 1, wherein adjustment of said plurality of pins provides a balance of corona output.

3. The corotron charging device of claim 1, wherein said pins are notched in order to more securely support said coronode wire.

4. The corotron charging device of claim 3, wherein said plurality of pins are positioned in a straight line adjacent to each other and are offset opposite to each other.

5. The corotron charging device of claim 1, wherein said plurality of pins are positioned on said support member in a zig-zag configuration.

6. The charging device of claim 1, including a screen positioned over said channel formed between said support member and said side members.

7. The corotron charging device of claim 1, wherein portions of said coronode wire are coated with an insulator to prevent corona.

8. A charging device having a charging region and adapted to uniformly charge a surface passing orthogonal thereto over long lengths, comprising:

a base member having a predetermined length;

side members attached to and extending orthogonal to said base member;

corona generating wire means extending said predetermined length of said base member while spaced from said base member and said side members; and support means within said charging region in the form of at least one monofilament adapted to directly support said corona generating wire means within a channel formed between said base member and said side members.

9. The charging device of claim 8, wherein said at least one monofilament is wrapped around and extends orthogonal to said corona generating wire means.

10. The charging device of claim 8, wherein said corona generating wire means is alternately laced over and under with said monofilament while both are situated in the same plane.

11. The charging device of claim 8, wherein said monofilament is in the same plane as said corona generating wire means and slanted with respect to said side members.

12. The charging device of claim 8, including screen means positioned over said channel formed between said base member and said side members.

13. The charging device of claim 8, wherein said support means comprises a plurality of monofilaments positioned at periodic intervals along said channel.

14. The charging device of claim 13, wherein portions of said coronode wire are coated with an insulator to prevent corona.

15. A scorotron charging device having a charging region and adaptable for charging a surface passing orthogonal thereto over long lengths, comprising:

a base member having a predetermined length;

side members attached to and extending orthogonal to said base member;

a plurality of pins positioned on a surface of said base member throughout the length of said base member and spaced a predetermined distance from said side members such that said plurality of pins are positioned within said charging region;

a coronode wire extending said predetermined length of said base member and supported by said plurality of pins; and a screen positioned between said surface and said coronode wire and adapted to smooth charge levels.

16. The scorotron charging device of claim 15, wherein portions of said coronode wire are coated with an insulator to prevent corona at those portions of said coronode.

* * * * *